US007465151B2

(12) United States Patent
Hong et al.

(10) Patent No.: US 7,465,151 B2
(45) Date of Patent: Dec. 16, 2008

(54) SHOCK-ABSORBENT STRUCTURE OF SERIALLY-CONNECTED FANS

(75) Inventors: Alex Hong, Kaohsiung (TW); Ming Chien Wu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 183 days.

(21) Appl. No.: 11/500,280

(22) Filed: Aug. 8, 2006

(65) Prior Publication Data

US 2008/0008576 A1 Jan. 10, 2008

(30) Foreign Application Priority Data

Jul. 4, 2006 (TW) ..... 95124304 A

(51) Int. Cl.
*F03D 11/00* (2006.01)

(52) U.S. Cl. ..... 415/119; 415/66; 416/125

(58) Field of Classification Search ..... 415/68, 415/66, 119; 416/126, 125; 361/695
See application file for complete search history.

(56) References Cited

U.S. PATENT DOCUMENTS

| | | | | |
|---|---|---|---|---|
| 5,208,730 | A * | 5/1993 | Tracy | 361/687 |
| 7,031,157 | B2 * | 4/2006 | Horng et al. | 361/695 |
| 2005/0106008 | A1 * | 5/2005 | Park et al. | 415/119 |
| 2007/0154300 | A1 * | 7/2007 | Liang | 415/119 |

* cited by examiner

*Primary Examiner*—Edward Look
*Assistant Examiner*—Dwayne J White
(74) *Attorney, Agent, or Firm*—Bacon & Thomas, PLLC

(57) ABSTRACT

The present invention relates to a shock-absorbent structure of serially-connected fans. The serially-connected fans at least include two fan frames. A shock-absorbent element is disposed between the bonded surfaces of the fan frames and is made of a flexible material being shock-absorbent and damping. Therefore, when the fan rotor inside the fan frame rotates, the fundamental frequencies of two fan rotors are damped, and absorbed by the shock-absorbent element, thereby preventing the interaction of the fundamental frequencies from generating severe resonant effect and noise out of vibration and maintaining the optimized efficacy and the life span of the system.

4 Claims, 3 Drawing Sheets

SHOCK-ABSORBENT STRUCTURE OF SERIALLY-CONNECTED FANS

FIELD OF THE INVENTION

The present invention relates to a shock-absorbent structure of serially-connected fans, and more particularly to a structure capable of solving the resonant effect arising from rotation of more than two fan rotors after multiple fans are serially connected for operation.

BACKGROUND OF THE INVENTION

A static pressure generated by two and more fans serially connected could be doubled when a wind capacity is zero. Each additional fan connected serially can increase wind capacity in a higher static pressure system. As a result, serially-connected fans can be a solution addressing an optimized effect to a system with high resistance.

As vibration always comes with rotation of fan, the only difference regarding vibration is the intensity thereof. In general, the higher static pressure and the bigger blades a fan has, the more critical vibration it will cause. Besides, vibration not only results in noise but also lessens system reliability, leading to premature fatigue and aging of electronic devices inside a system and shortening the life span of the system.

As shown in FIG. 1, the serially arranged fans at least includes two fan frames 10, which provide corresponding retaining parts 11 and grooves 12 respectively so as to get the two fan frames 10 serially engaged.

The fan frame 10 has a hollow containing space therein for accommodation of a fan rotor (not shown), and a base 13 is disposed at one end of the containing space and is integrally integrated with the fan frame 10 by means of a plurality of ribs 14. The base 13 is provided for mounting a driving device (not shown and not depicted in the present invention further as the operation of the fan rotor and the driving device is a conventional technique and is not associated with the present invention directly) that is used to drive the fan rotor to rotate. The holes between the ribs 14 are provided as a passage for air flow circulation.

As the two fan frames 10 are directly contacted and serially integrated in the aforementioned serially-connected fan, the resulting shortcomings are concluded as follows:

Severe resonant condition due to serial connection of the two fan frames 10: The design concept of motor rotation by torque will inevitably generate vibration. Especially when the fan rotors inside the two fan frames 10 of the serially-connected fans rotate simultaneously, the two fan frames 10 will generate severe resonant effect resulting from the interaction of the fundamental frequency of vibration generated by the two fan frames 10, and the resonant effect will be transmitted to system, making system fail to perform its optimized efficacy.

Shorter life span arising from the resonant effect: When a system is subjected to resonant effect over a long period of time, such effect not only accelerates the premature fatigue and aging of the contact points of electronic devices but also shortens the life span of the system.

Acute noise out of vibration: Resonant effect also gives rise to gigantic noise, which impacts on the entire noise value assessment of system remarkably.

Consequently, to completely solve the resonant issue of the aforementioned serially-connected fan frames and maintain the optimized performance and the life cycle of the system, a more positive damping and shock-absorbent measure to lower fundamental frequencies of vibration of the serially-connected fan frames and get rid off interaction and transmission of vibration amplitude resulting from rotation of the fan rotor shall be in place. In that sense, developing a shock-absorbent structure for serially-connected fans is indispensable.

SUMMARY OF THE INVENTION

In view of the foregoing concern, the present invention thus provides a shock-absorbent structure of serially-connected fans, wherein the serially-connected fans are composed of two or more fans that are serially connected, a shock-absorbent element is disposed between two surfaces of the fan frames of the serially-connected fans where are bonded, and the shock-absorbent element shall be made of a flexible material being shock-absorbent and damping to vibration.

Hence, when the fan rotor inside the fan frame rotates, the shock-absorbent feature of the shock-absorbent element is applied to lower the fundamental frequencies of the two fan rotors and to damp and absorb the vibration amplitude thereof, thereby avoiding the interaction of the fundamental frequencies of vibration generated by the two fan rotors and preventing the severe resonant effect and noise out of vibration to maintain the optimized efficacy and life span of the system.

DETAILED DESCRIPTION OF THE PREFERRED EMBODIMENT

The present invention relates to a shock-absorbent structure of serially-connected fans, wherein the serially-connected fans are composed of at least two fans that are serially connected, a shock-absorbent element is disposed between the jointed surfaces of two neighboring fan frames, and the damping and shock-absorbent characteristics of the shock-absorbent element itself are utilized to isolate and reduce the fundamental frequency of vibration of the serially-connected fans.

Listed below are two preferred embodiments illustrative of actual applications for dual fans that are serially connected.

Figure 1:
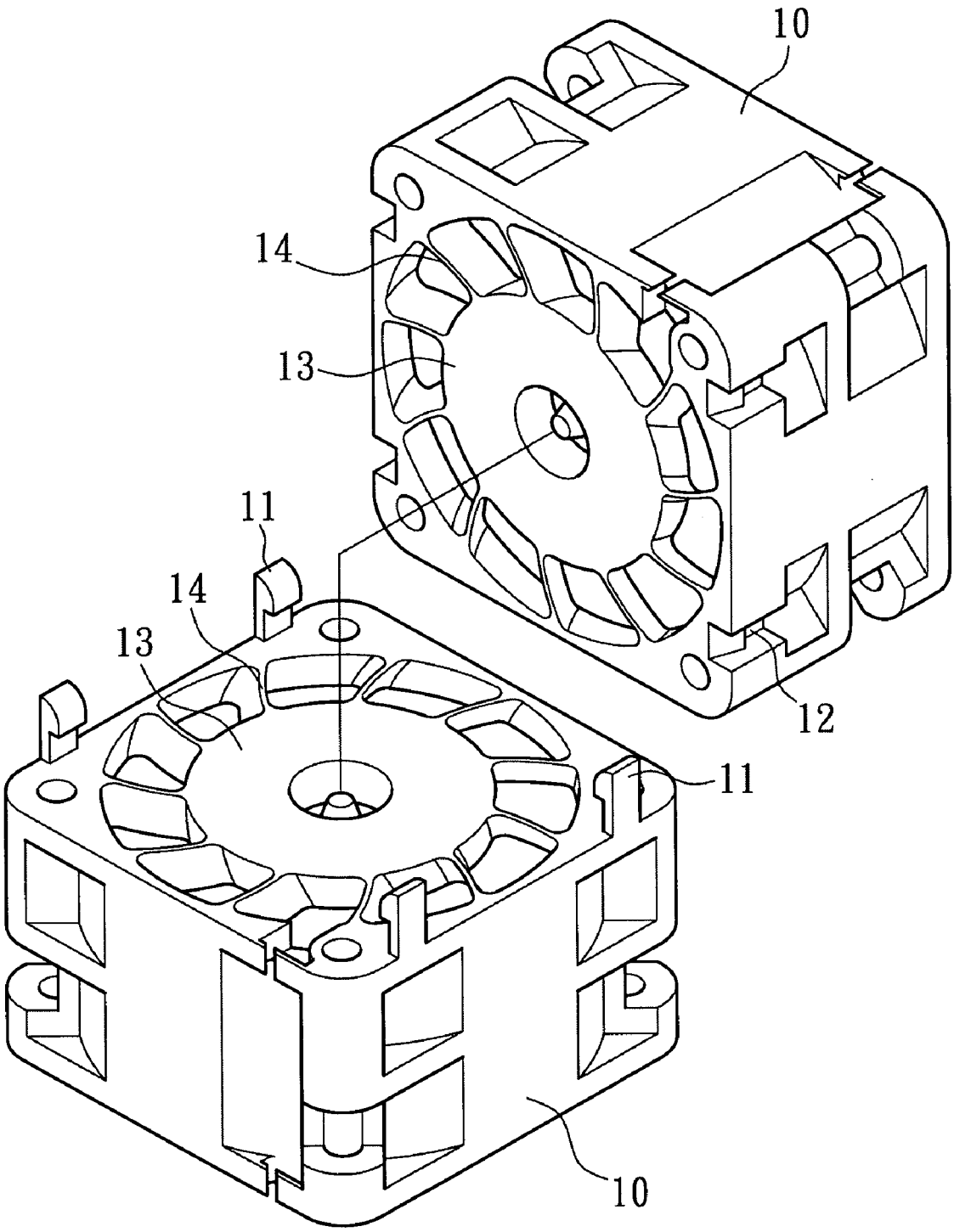
FIG. 1 is an exploded view showing a conventional structure of serially-connected fans.
Figure 2:
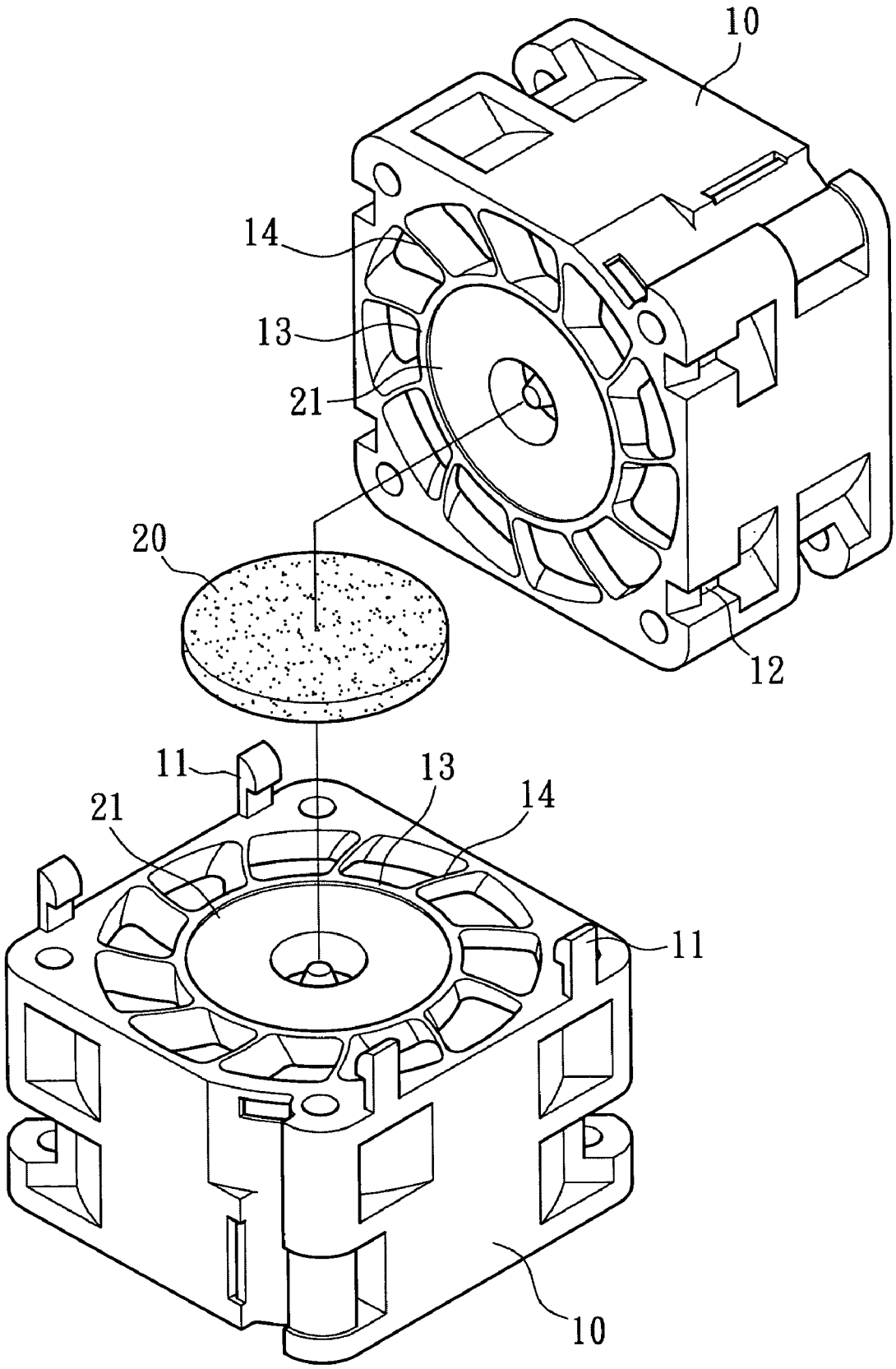
FIG. 2 is an exploded view showing a first preferred embodiment.

Please refer to FIG. 2. The serially-connected fans implemented in the present invention includes at least two fan frames 10, and a retaining part 11 and a groove 12 where are the counter part each other for the two fan frames 10 to be serially connected and engaged.

The fan frame 10 has a hollow containing space for accommodating a fan rotor (not shown), and a based 13 is disposed at one end of the containing space. The base 13 is integrally integrated with the fan frame 10 by means of a plurality of ribs 14, in which the base 13 is for assembling a driving device (not shown) to drive the fan rotor for operation. The holes between ribs are provided as a passage for air flow circulation.

The present invention further provides a shock-absorbent element 20 disposed between the surfaces of the two fan frames to be serially connected. The form of the shock-absorbent element 20 corresponds to and shall not be greater than the shape of the base 13. A shallow recess 21 is provided on an external end surface of a respective base 13 of the two serially-connected fan frames, such that the shock-absorbent element 20 can be disposed between the two shallow recesses 20 and sandwiched and fastened by the two bases 13.

The shock-absorbent element 20 shall be made of a flexible material being shock-absorbent and damping, e.g. rubber, foam, sponge, polyurethane and the like. As such, when the fan rotors inside the two fan frames 10 rotate at the same time, the vibration amplitude arising from rotation of two fan rotors is absorbed and isolated by the shock-absorbent element 20, ensuring that the fundamental frequencies of the two fan rotors won't be interacted to avoid the generation of resonant effect and noise.

Further refer to Annex 1 and Annex 2. The Annex 1 and 2 are the tables containing the vibration test values measured from the identical serially-connected fans in accordance with the rotation speeds at 15,000 rpm and 14,000 rpm respectively.

Annex 1 is a vibration test value table for a conventional structure, where the measured vibration speed value Acc_0.5G is 0.00947 m/s, and the vibration acceleration value Acc_0.5G is 17.2 m/(s2). Annex 2 is a vibration test value table for the present invention, where the measured vibration speed value Acc_0.5G is 0.00349 m/s, and the vibration acceleration value Acc_0.5G is 8.89 m/(s2).

The above-mentioned test results signal that the shock-absorbent element 20 of the present invention allows the vibration speed of entire serially-connected fans and the vibration acceleration to drop 63% and 48% respectively. Therefore, the shock-absorbent element 20 can effectively isolate and damp the fundamental frequencies of two fan rotors indeed, whereby the fundamental frequencies of vibration of the two fan rotors won't be interacted, to prevent the serially-connected fans from generating resonant effect and noise.

Figure 3:
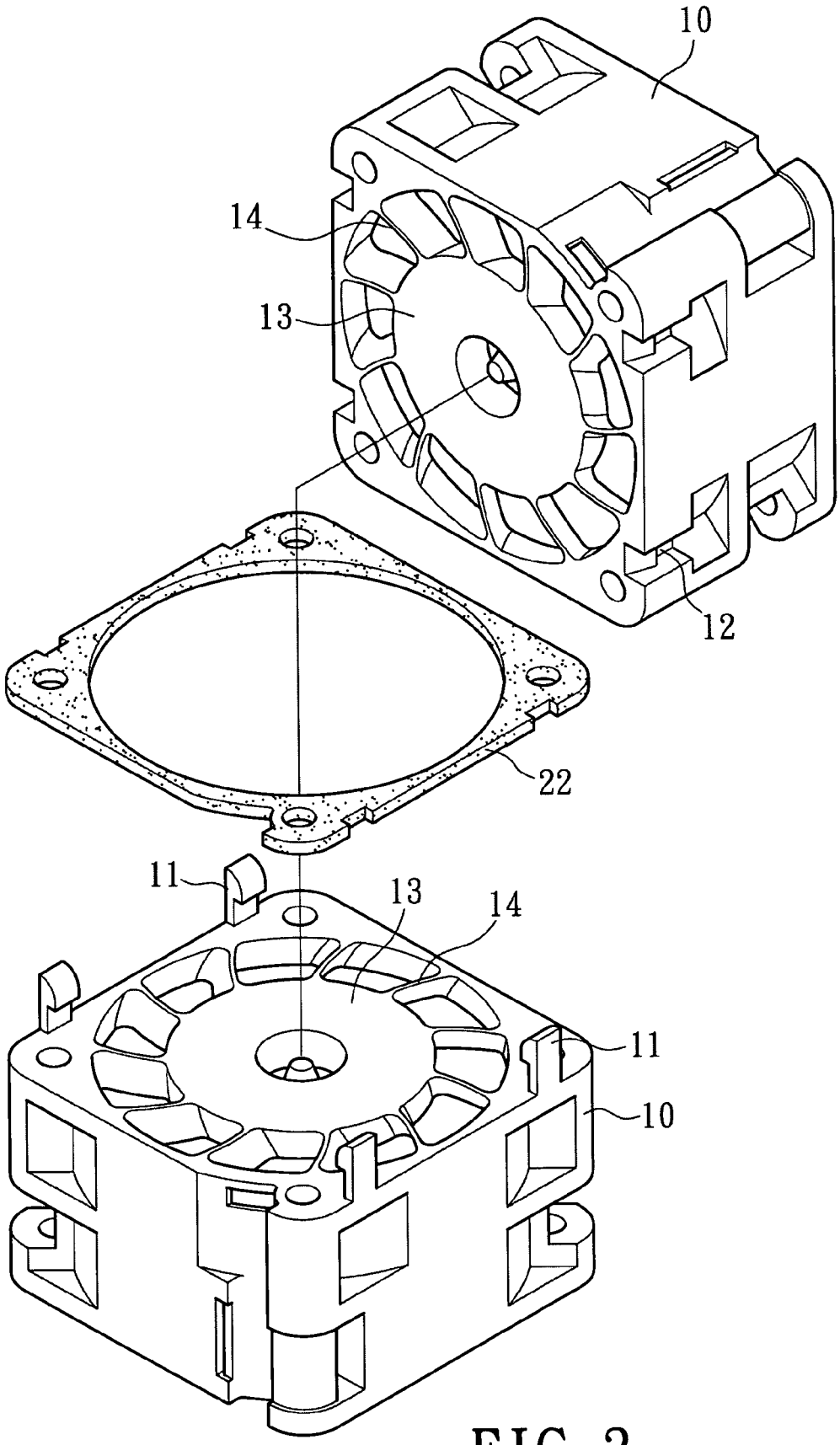
FIG. 3 is an exploded view showing a second preferred embodiment.

Besides, FIG. 3 is another preferred embodiment of the present invention. The shock-absorbent element is also disposed between the surfaces of the two fan frames 10 serially connected, and the form of the shock-absorbent element matches with that of the bonding surfaces of the two fan frames. When the two fan frames are serially connected, the absorbent element 22 is sandwiched and fixed at the same time to in turn absorb, isolate and damp the fundamental frequencies of vibration of the two fan rotors and to prevent the interaction thereof from resulting in a critical resonant effect.

After comparing the shock-absorbent structure of the serially-connected structure in the present invention with the aforementioned conventional structure, the present invention at least includes the following characteristics of:

alleviating vibration and generating no resonant effect: The present invention employs a damping and shock-absorbent measure in a positive manner. Using the damping and shock-absorbent nature of the shock-absorbent element can isolate and lower the fundamental frequencies of serially-connected fans to avoid the severe resonant effect of fan generated by the interaction of the fundamental frequencies of vibration.

maintaining the optimized efficacy and the life span of system: The shock-absorbent element damps and absorbs the fundamental frequencies of serially-connected fans and avoids to result in the resonant effect. As a consequence, when a system is no longer subjected to the impact on the vibration amplitude resulting from rotation of the fan rotors, it can make the most of the optimized efficacy of the system and secure a normal operation life duration.

generating no resonant noise: The shock-absorbent element not only isolates and damps vibration but also prevents from further generating resonant noise.

In sum, the present invention surely possesses the aforementioned benefits and provides a substantial performance improvement in comparison with the conventional structure. Furthermore, the present invention not only has a novelty among similar products and a progressiveness, but also has an industry utility.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A shock-absorbent structure of serially-connected fans, comprising;

at least two serially-connected fans having a respective fan frame, wherein said fan frame has a containing space therein for accommodating a fan rotor, a base is disposed at one end of said containing space, said base is integrally combined with said fan frame by means of a plurality of ribs, and said base is provided for mounting a driving device to drive said fan rotor to rotate; and a shock-absorbent element is disposed between two bonded surfaces of two of said fan frames, and said shock-absorbent element is made of a flexible material being shock-absorbent and damping wherein a form of said shock-absorbent material corresponds to and is not greater than that of said base, and a shallow recess is provided on an external end surface for accommodating said shock-absorbent element.

2. The shock-absorbent structure of serially-connected fans of claim 1, wherein said shock-absorbent material is selected from a group containing rubber, foam, sponge and polyurethane.

3. The shock-absorbent structure of serially-connected fans of claim 1, wherein a form of said shock-absorbent element corresponds to that of said bonded surface of said fan frame.

4. The shock-absorbent structure of serially-connected fans of claim 1, wherein a retaining part and a groove are disposed on two neighboring fan frames respectively and are counter parts to each other for said respective fan frames to be serially engaged.

* * * * *